United States Patent [19]

Schurman

[11] 3,933,381

[45] Jan. 20, 1976

[54] PLASTIC CONTAINER AND LATCH

[75] Inventor: Peter T. Schurman, Woodbridge, Conn.

[73] Assignee: The Plastic Forming Company, Inc., Woodbridge, Conn.

[22] Filed: Nov. 4, 1974

[21] Appl. No.: 520,541

[52] U.S. Cl. ..... 292/57; 292/DIG. 42; 292/DIG. 48

[51] Int. Cl.[2] ..... E05C 5/02

[58] Field of Search ..... 292/4, 57, 58, 59, 60, 292/61, 62, 67, DIG. 42, DIG. 48, 337, 304; 425/326; 70/71

[56] References Cited

UNITED STATES PATENTS

| | | | |
|---|---|---|---|
| 708,892 | 9/1902 | Long | 292/57 X |
| 798,583 | 8/1905 | Harris | 292/57 |
| 2,403,065 | 7/1946 | Engert | 292/57 |
| 3,659,999 | 5/1972 | Schurman | 425/326 |

FOREIGN PATENTS OR APPLICATIONS

| | | | |
|---|---|---|---|
| 999,390 | 7/1965 | United Kingdom | 292/57 |
| 687,465 | 4/1930 | France | 292/57 |
| 170 | 1/1898 | United Kingdom | 292/337 |

*Primary Examiner*—Robert L. Wolfe
*Attorney, Agent, or Firm*—Christel & Bean

[57] ABSTRACT

A blow-molded plastic container base and cover portions formed of double wall construction are hinged together for movement between open and closed positions with respect to one another. A latch assembly is provided for positively locking the cover portion in a closed disposition. The latch assembly includes an elongated bolt means slidably mounted within a trough-shaped groove in the front of the cover portion. The cover and base further include formed portions which matingly engage with one another upon closing of the cover and which include aligned locking apertures. Upon closing of the cover portion, the bolt means may be slid axially into the aforesaid apertures to positively lock the cover and base together. The bolt means further includes a detent means extending radially outward and which may be rotated into a cut-out portion in the trough-shaped groove when the bolt is engaged within the locking apertures. The detent means thereby serves to axially lock the bolt into a fixed position when the cover is locked to the base portion of the container.

8 Claims, 13 Drawing Figures

Fig. 1.
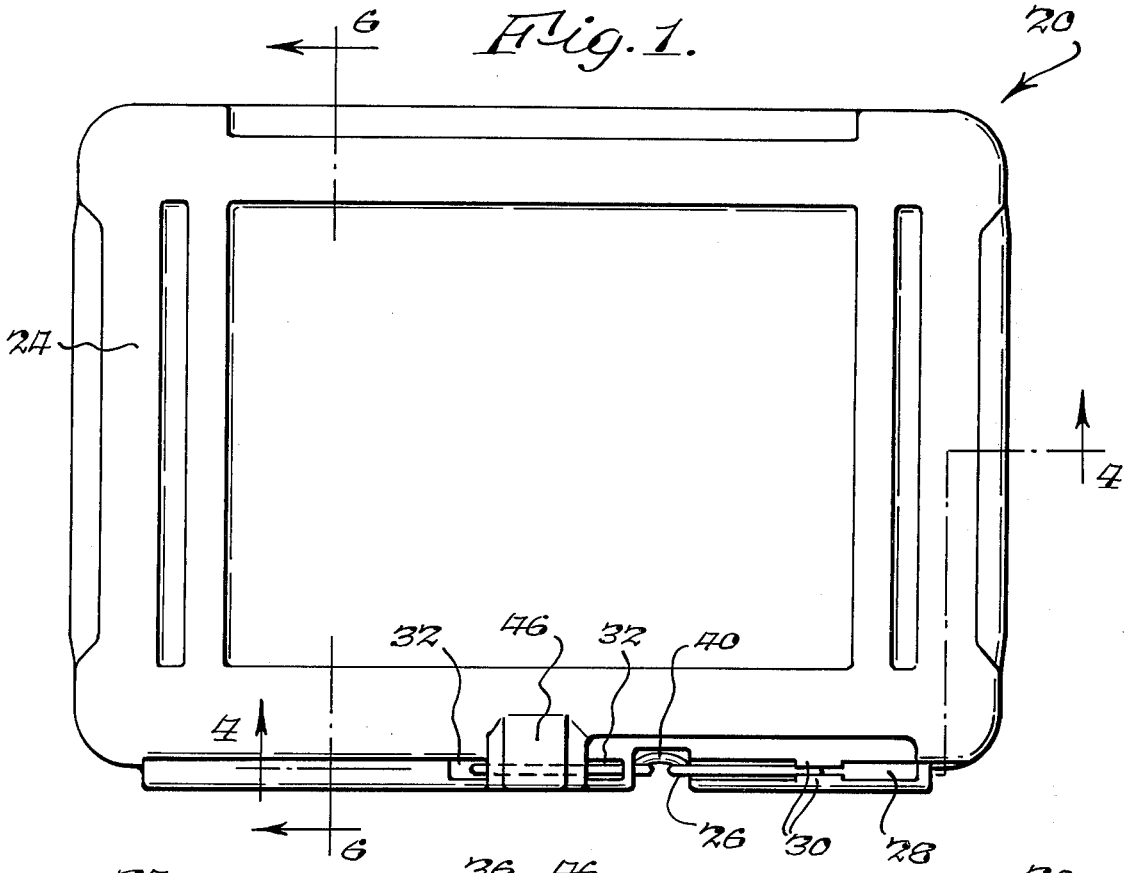
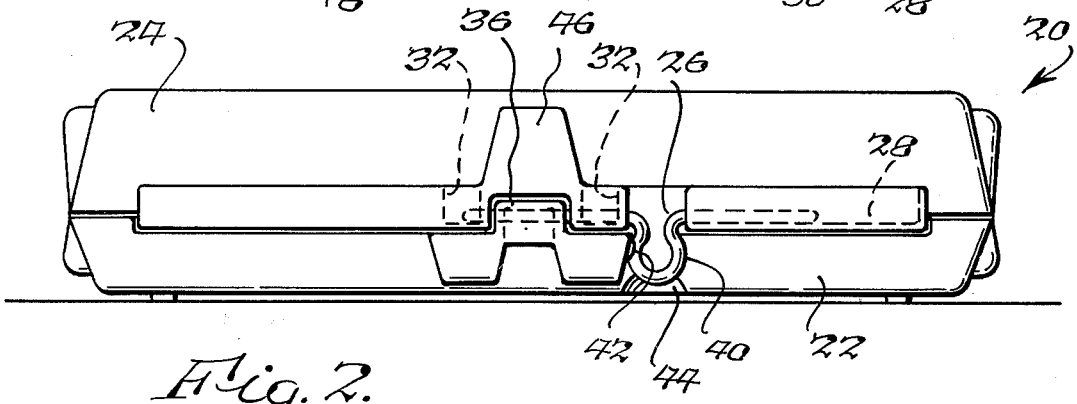
Fig. 2.
Fig. 3.
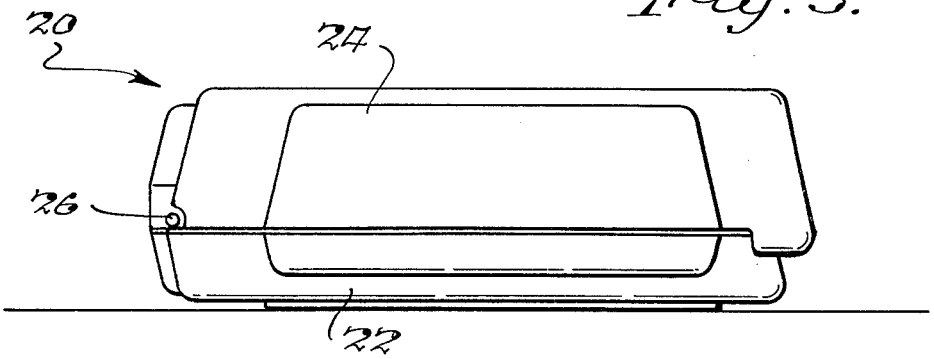

20
24
22
28
30
9
9
40
26
42
40
44
8
8
34
32
34
46
7
7
36
38
38
34
32

24
28
30
30
26
40
34
32
34
38
36
38
34
32
22
24

20
24
22

24
30
22
40
28
30
26

24
22
40
46
26
34
40

24
22
24
46
36
26
38
22

PLASTIC CONTAINER AND LATCH

BACKGROUND OF THE INVENTION

This invention relates generally to the plastic container art, and more particularly to a new and improved plastic container and associated latch for locking the blow molded cover and base portions thereof together in the closed position of the cover.

The provision of a container body separate from its cover has certain advantages in production and in the fact that it permits merchandise to be shrink-wrapped in the body prior to application of the cover. It also permits utilization of different materials and materials of different color, in forming the cover and body portions. The blow-molding of such container parts is itself quite desirable from various points of view. For example, the provision of a container body, and cover of hollow, doulbe-wall construction provides a cushioned arrangement wherein the inner wall can be shaped to engage and receive the article being packaged. Such double-wall construction of a container cover and base portions are known and described in the prior art, as for example in U.S. Pat. No. 3,659,999, issued on May 2, 1972 and assigned to the same assignee of the present invention.

Problems are encountered however in providing a suitable latch for such hinged container parts. Where the latch is formed separate from the container parts, an additional assembly step is involved, potentially adding to production costs. While this situation can be avoided by molding the latch integral with one of the container parts, problems remain in providing a latch of sufficient strength and durability without imposing undesirable design limitations. An additional problem with prior art latches exists with the relative degree of positive locking imparted to the cover and base portions of a container. In a number of situations where blow molded containers are utilized to transport or convey various articles, it is desirable to have a latch which will not open when subjected to accidental jarring or transient impact which could "spring" the latch. Some prior art latches which are molded integral with one of the container parts to provide simply a snap-type of latching are particularly vulnerable to any type of such jarring impact.

SUMMARY OF THE INVENTION

Accordingly, an object of this invention is to provide a separate latch element which facilitates design and manufacture of the body and cover portions of a container.

Another object of this invention is to provide a separate latch element which is easily assembled with the cover portion of a blow molded container of double-wall construction.

Another object of the present invention is to provide a latching means for the aforesaid blow molded container which will be securely mounted to the container and provide positive locking to the body and closed cover portion thereof which will not be subject to opening through accidental jarring or impact forces.

A still further object of this invention is to provide a latch construction for a blow molded container which includes excellent latching action, simplified operation, and which is only moderately stressed during movement between the latched and released positions.

In summary, the present invention provides an axially sliding bolt-type of latch for positively locking the cover and base portions of a blow molded plastic container together. More specifically, a trough-shaped groove is provided on the front portion of the container cover and the aforesaid bolt means is mounted slidably therein and biased towards the bottom of the groove by protruding resilient sidewall portions in the groove. Upon closing of the cover portion of the container, apertures disposed in a protruding shoulder portion of the cover which are structurally aligned with the bolt means, become aligned with additional apertures on the base portion of the container. In this manner, after closing of the cover, the bolt means may be axially urged to engage all of the aforesaid apertures and provide positive locking between the cover and base. In addition, an additional locking means is provided on the bolt itself to prohibit accidental axial sliding of the bolt out of engagement with the above locking apertures.

The foregoing and other objects, advantages and characterizing features of the present invention will become clearly apparent from the ensuing detailed description of an illustrative embodiment thereof, taken together with the accompanying drawings wherein like reference characters denote like parts throughout the various views.

BRIEF DESCRIPTION OF THE DRAWINGS

FIG. 1 is a top plan view of an illustrative container in closed position embodying the present invention;

FIG. 2 is a front elevational view thereof;

FIG. 3 is a side elevational view thereof;

DETAILED DESCRIPTION OF PREFERRED EMBODIMENTS

Figures 4, 5:
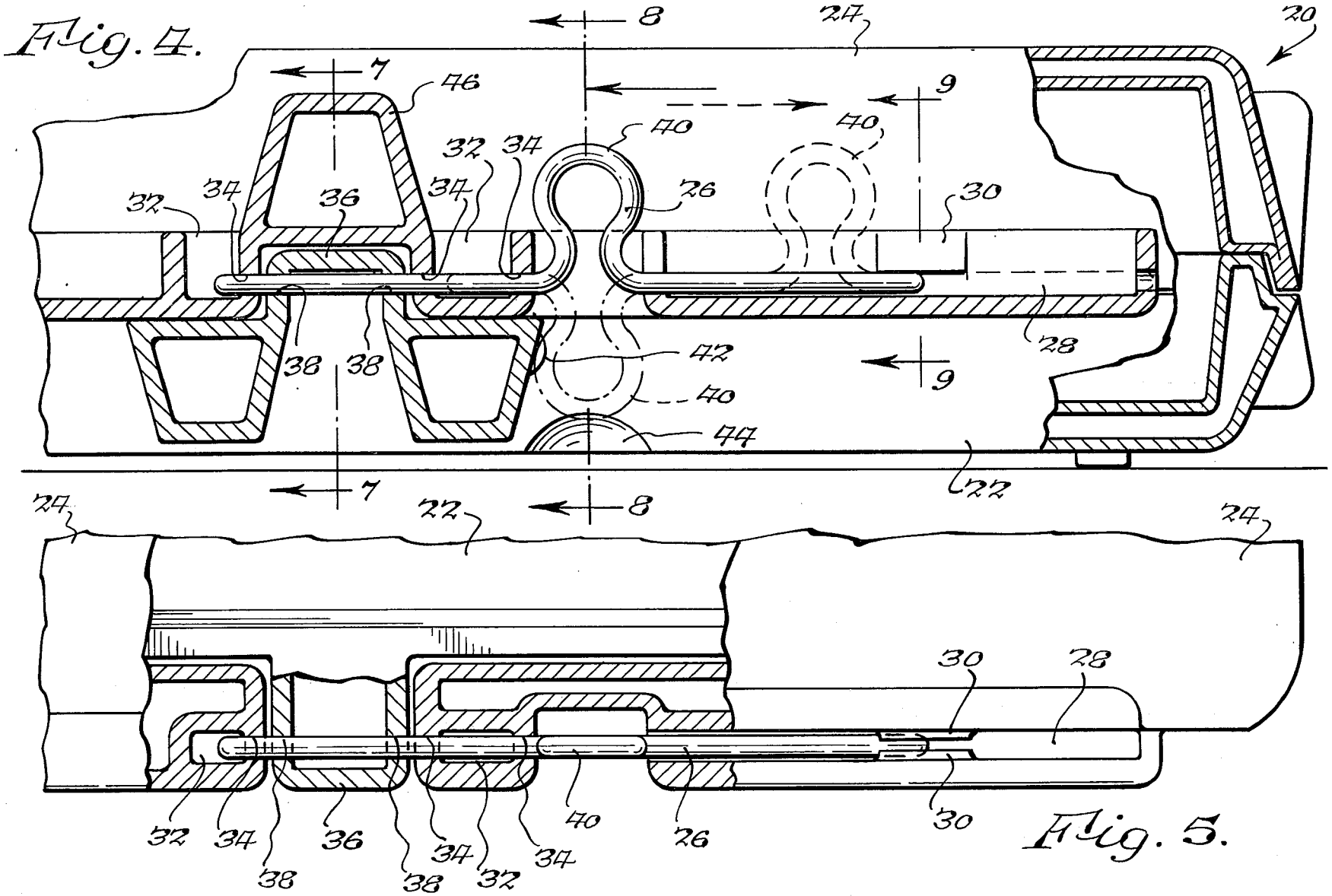
FIG. 4 is a fragmentary vertical sectional view, on an enlarged scale, taken about on line 4—4 of FIG. 1 showing the latch means of the present invention in detail.
FIG. 5 is a fragmentary top view in section taken about on line 5—5 of FIG. 4.

Referring now in detail to the illustrative embodiments depicted in the accompanying drawings, there is shown in FIGS. 1 and 2 a plastic container 20 which includes a base portion 22 and cover portion 24. As further shown in FIG. 3 of the drawings, base 22 and cover 24 are hingedly connected one to another at 26 for relative movement between an open and closed position of the cover 24 with respect to the base or body portion 22. As further shown in FIG. 6 the container portions, being formed of a thermoplastic material, include a doublewall blow molded construction. Through the use of such doublewall construction, a cushioned arrangement is provided wherein the inner walls of the base and cover portion can be shaped or formed to receive and engage the article being packaged or transported. It is to be further appreciated from FIGS. 1–4 that the base and cover portion of the container further include mating edges about their respective peripheral areas for providing a generally sealed container when the cover portion is in a closed position and locked as will be described hereinbelow.

As generally shown in FIG. 2, a bolt means 26 is shown in a latched position locking the base and cover portions together. One end of the bolt means 26 is mounted in a trough-shaped groove 28 as shown in detail in FIGS. 5 and 9. The bolt means is both rotatable and axially slidable within the trough-shaped groove and is biased downwardly into a mounted engagement with the bottom of the groove by the resilient sidewall portions 30 of the groove. The sidewall portions 30 are formed integral with the groove to provide an interference type of fit which precludes looseness and random movement of the bolt means within the groove.

As further shown in FIG. 2, the cover portion 24 includes a bolt mounting channel portion 32 which includes three locking apertures 34 as seen in detail in FIGS. 4 and 5. The locking apertures 34 are aligned with one another and with the trough-shaped groove 28 so that the second end of the bolt means 26 may be axially slid into and out of engagement with the locking apertures 34.

The base or body portion 22 of the container further includes a locking shoulder 36 as shown in detail in FIGS. 4 and 5. The locking shoulder also includes two locking apertures denoted as 38. When the cover 24 is in a closed position, the locking apertures 38, being aligned with one another, become aligned with the locking apertures 34 so that the bolt means 26 may be axially engaged within all of the aforesaid locking apertures so that the base and cover portion of the container are affirmatively or positively locked one to another.

Figures 6, 7, 8, 9:
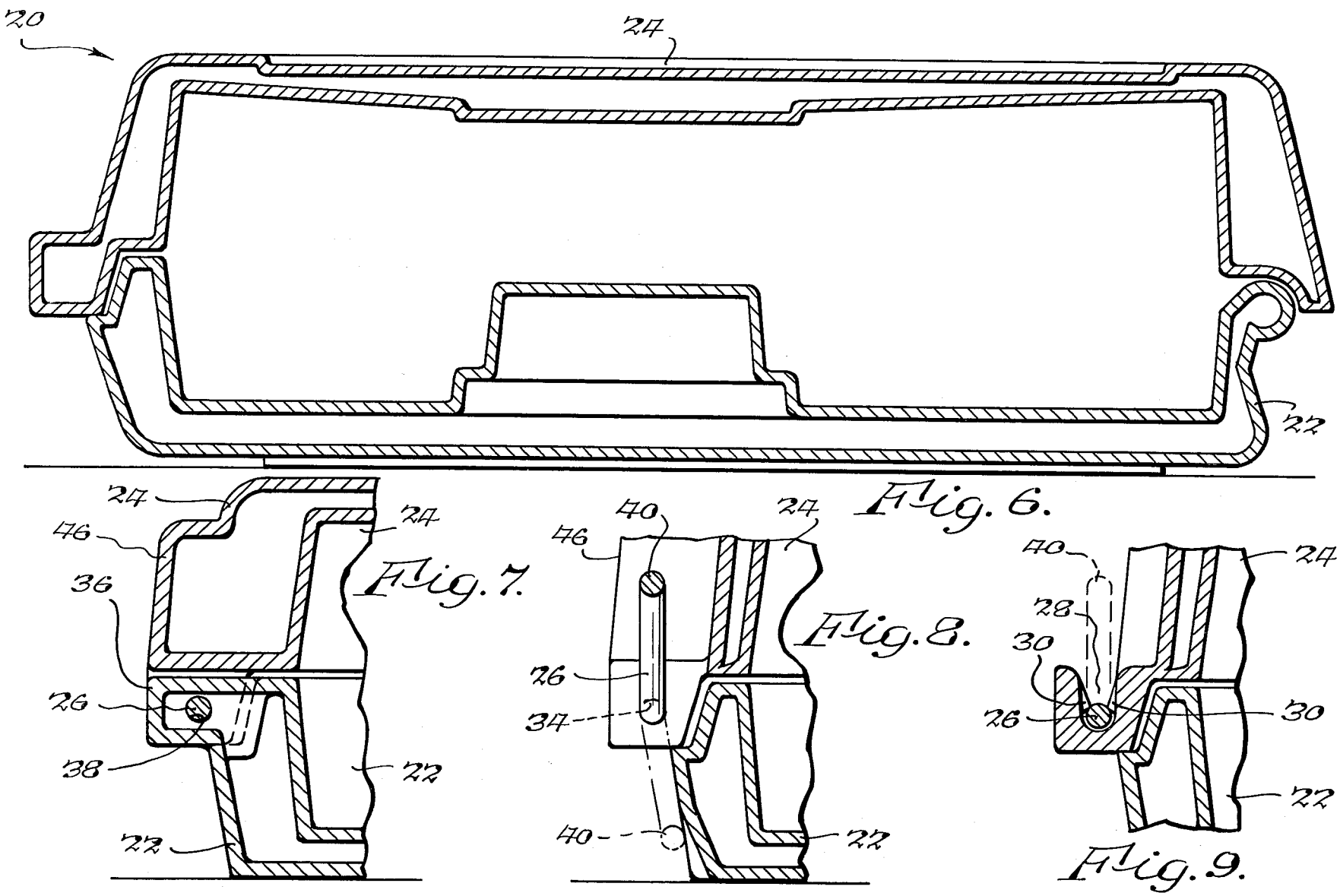
FIG. 6 is a vertical sectional view taken about on line 6-6 of FIG. 1.
FIG. 7 is a fragmentary vertical sectional view taken about on line 7—7 of FIG. 4 showing vertically overlapping portions of the base and cover portions of the container which are engaged by the bolt means of the present invention.
FIG. 8 is a fragmentary vertical sectional view taken about on line 8—8 of FIG. 4.
FIG. 9 is a fragmentary vertical sectional view taken about on line 9—9 of FIG. 4 showing the trough-shaped groove in which a bolt means of the present invention is mounted.

As seen in more detail in FIGS. 4 and 7, two of the locking apertures 34 are spaced from one another by a downwardly opening recess or cavity in the bolt mounting channel 32. Correspondingly, the locking shoulder 36 on the base portion 22 is so formed to matingly be received within the aforesaid recess on the bolt mounting channel when the cover is moved to a closed position as shown in FIG. 2. It can be appreciated, therefore, that the mating edges of the base and cover portions adjacent to the aforesaid recess on the cover and the locking shoulder on the base will provide ready alignment of the locking apertures 34 and 38 to thereby assure facilitated engagement of the bolt means 26 therein. As shown further in FIG. 7, it can be seen that all of the locking apertures will be aligned by the lower edge of the bolt mounting channel 32 coming into abutment with the top edge of the base portion adjacent to the locking shoulder.

As further illustrated in FIG. 4, the bolt means 26 is formed of a wire material and includes a detent means or loop means 40 extending radially outward from the circumferential surface of the midportion of the bolt. The detent means 40 may be used to grasp the bolt means for urging the latter in an axial direction. As shown in FIG. 4, a recess or cut-out portion is provided between bolt mounting channel 32 and the end of the trough-shaped groove 28 so that the detent means or loop 40 may be rotated through an angular movement of substantially 180° as indicated by the dotted line positions in FIGS. 4 and 8. It is to be further understood that the recess between bolt mounting channel 32 and the groove 28 could merely be a cut-out portion anywhere along the length of the trough-shaped groove 28 which would eliminate interference to rotation of the detent means when the latter was longitudinally aligned therewith.

In utilizing the embodiment of the present invention illustrated in FIGS. 1–9, it is to be understood that the cover portion 24 would be free to be opened and closed with respect to the base 22 when the bolt means 26 is urged axially to the right as seen in FIG. 4 with the detent means 40 assuming the position shown in dotted lines therein. In view of the trough-shaped cross section of the groove 28, it is possible to slide the bolt means 26 to the right in FIG. 4 and out of engagement with the apertures 38 only when the detent or loop means 40 has been rotated to assume essentially a vertically upward disposition as shown in FIGS. 4, 8 and 9. Upon desired closing and latching of the cover portion to the base portion of the container, the molded locking shoulder 36 on the base will be received within the opposed recess in the molded channel 32 between the locking apertures 34 as shown in FIG. 4. The locking apertures 38 on the molded shoulder 36 will become aligned with the locking apertures 34 on the molded channel 32 and the bolt means 26 may be axially urged to the left as shown in FIG. 4 by grasping the loop or detent means 40. Upon sufficient translation of the bolt means to the left as shown in FIG. 4 all of the locking apertures 34 and 38 will be engaged thereby. In such a disposition, the cover is affirmatively locked to the base.

In addition to the locking of the cover to the base, means are further provided for locking the bolt 26 in a fixed longitudinal position so that it may not be accidentally jarred loose and out of engagement with the locking apertures 34 and 38. In accordance with this objective the loop portion 40 may be rotated through essentially 180° to assume the position shown in dotted lines in FIGS. 4 and 7 when the loop 40 is longitudinally aligned with the cut-out portion at the end of the groove 28 shown in FIG. 4. As the loop 40 is rotated to the downward disposition, a protuberance 42 is engaged and snappingly overridden by the final rotational movement of the loop. With the loop 40 therefore being resiliently urged towards the front exterior wall of the base portion as shown in FIG. 8, the bolt means may not be inadvertently jarred to the left and out of engagement with the locking apertures 34 and 38 in view of the abutment of the loop 40 with the adjacent structure of the trough-shaped groove 28. When it is desired to open the container, a finger recess 44 is provided in the base portion directly beneath the loop 40 so that the latter may be easily grasped and rotated over the protuberance 42 to its vertically upward disposition. After such rotation, the bolt means may be slid to the right out of engagement with the locking apertures 34 and 38.

Should it be desired to maintain the cover in a locked disposition and the loop means 40 accidentally is either left in the upward disposition shown in FIG. 4 or somehow becomes displaced to such upward disposition, a safety shoulder 46 is molded into the front of the cover portion adjacent to the cut-out portion at the end of the groove 28. The safety shoulder 46 serves to shield the upwardly oriented loop 40 in FIG. 4 from lateral contact which would tend to urge the loop and bolt means to the right thereby allowing the cover to become unlocked from the base portion.

Figures 10, 11, 12, 13:
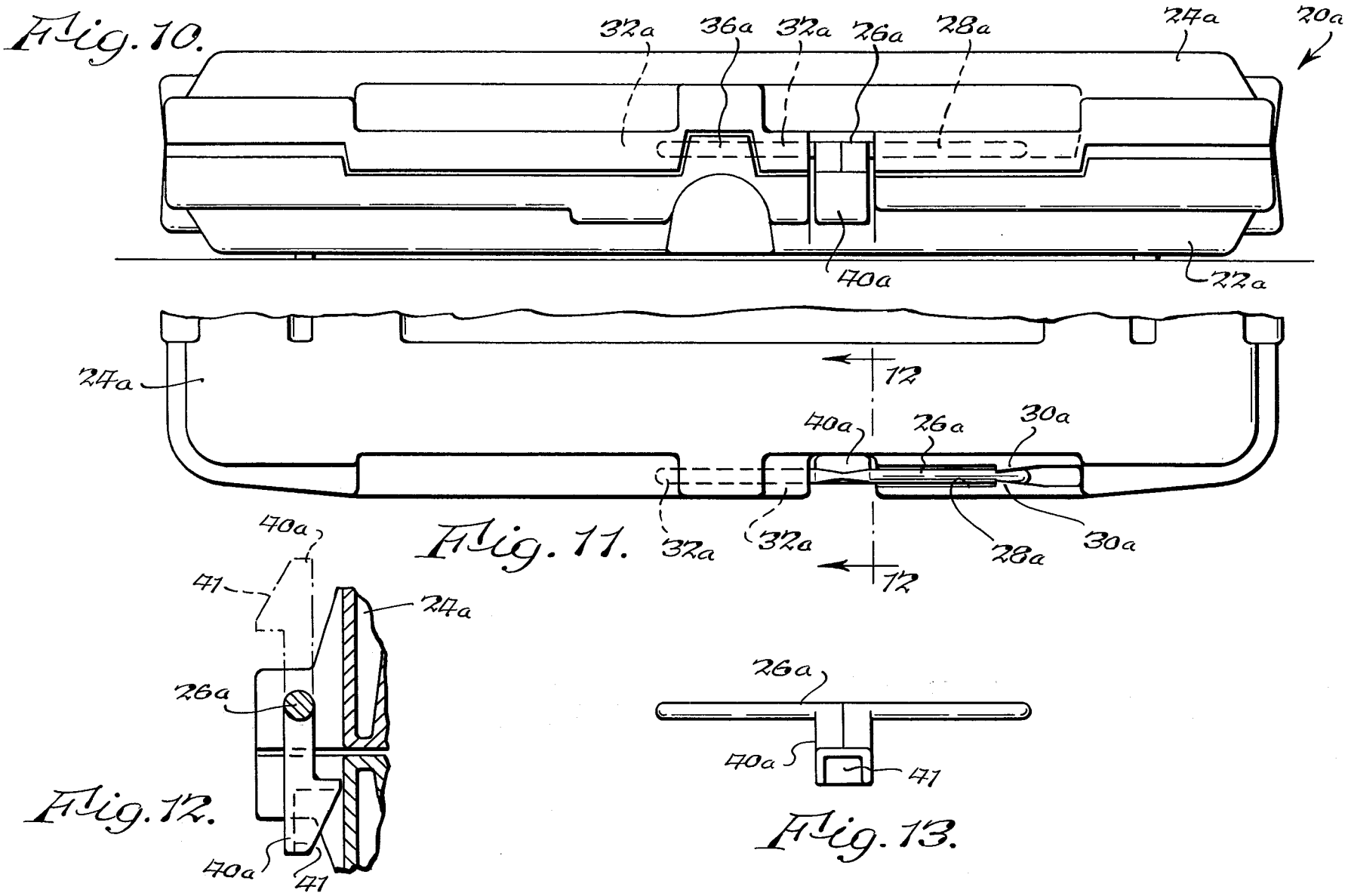
FIG. 10 is a front elevational view of a blow molded container incorporating a latching bolt means constituting a second embodiment of this invention.
FIG. 11 is a fragmentary top plan view of the container shown in FIG. 10.
FIG. 12 is a fragmentary vertical sectional view taken about on line 12—12 of FIG. 11 showing a bolt means employed in the second embodiment of the present invention.
FIG. 13 is a detailed view specifically showing a reverse longitudinal side view of the bolt means shown in FIG. 12.

A second embodiment of the present invention is illustrated in FIGS. 10–13 which incorporates a bolt means molded out of a thermoplastic material as opposed to the wire formed bolt means 26 described hereinabove. As shown in FIGS. 10 and 11, a trough-shaped groove **28*a* is provided for slidably receiving one end of the bolt means 26*a* shown in detail in FIG. 13. The groove 28*a* further includes resilient side portions 30*a* which resiliently bias the bolt means into a seated engagement with the bottom of the groove 28*a*. The other end of the bolt means 26*a* may be received in locking apertures which are defined in a bolt mounting channel 32*a* on the cover of the container and in a locking shoulder 36*a* on the base portion of the container, all being analagous to the corresponding description of such elements given above. As can be appreciated from viewing FIGS. 11 and 12 together, bolt means 26*a* also includes a detent means 40*a* extending radially outward from the midportion of the bolt means. When the bolt means is engaged within all of the locking apertures and is longitudinally aligned with the cut-out section between the groove 28*a* and mounting channel 32*a*, detent means 40*a* may be rotated substantially 180° to assume the downward disposition shown in FIG. 12. Correspondingly, the bolt means may only be axially moved into and out of engagement with the locking apertures when the detent means 40*a* is disposed in the upper disposition shown in dotted lines in FIG. 12. The engagement therefore of the detent 40*a* with the end of the groove 28*a* when the detent is rotated to its lower disposition shown in FIG. 12 serves the same purpose as loop means 40 described above wherein the respective bolt means may not be jarred out of engagement with the respective locking apertures. It is to be noted also that the molded bolt means 26*a* includes a recess 41 at the free end thereof. Provision of the recess 41** enables a user of the container to easily grasp the detent means and rotate it to the desired annular disposition.

From the foregoing, it is apparent that the objects of the present invention have been fully accomplished. As a result of this invention, a sliding and rotating bolt means is provided on the cover portion of a plastic container for engaging three molded bolt receiving portions of double-wall channels with end walls, two on the cover forming part of the bolt mounting channel and one on the base portion comprising the locking shoulder. Once engaged, the bolt means may be axially retained by rotation of a detent means on the bolt into axial engagement with the adjacent mounting groove for such bolt means.

Therefore, it can be seen that the separate manufacture of a bolt means simplifies the design and manufacture of the base and cover portions. Although such separate manufacture of the bolt means involves assembling the bolt into the cover, this can be easily accomplished by a consideration of FIG. 4. As can be easily visualized, the bolt 26 is assembled within the cover by merely pressing the bolt into engagement with the resilient sidewalls of the trough-shaped groove whereby the bolt would be aligned for sliding engagement within the locking apertures 34.

I claim:

1. A latch assembly for a container wherein the container includes a base portion and cover portion of double wall thermoplastic construction hingedly connected to one another for movement between open and closed positions relative thereto and with mating edges on said base and cover portions adapted to abut in the closed position of said cover portion, said latch assembly comprising:

a bolt means, one end of said bolt means being mounted within a groove on said cover portion and being axially slidable therein;

a bolt mounting portion disposed on said cover portion in alignment with said groove; and locking apertures, at least one locking aperture disposed on said bolt mounting channel and on said base portion, said locking apertures being aligned with one another in the closed position of said cover portion for axially receiving the second end of said bolt means so that said cover and base portions may be selectively locked together.

2. A latch assembly as set forth in claim 1 wherein said bolt mounting portion on said cover portion includes at least two aligned locking apertures spaced from one another by an interposing recess formed in said bolt mounting portion, a locking shoulder on said base portion, said locking shoulder being apertured and adapted to be received in said recess of said cover portion upon closing thereof so that all of said apertures are in axial alignment for receiving said second end of said bolt means.

3. A latch assembly as set forth in claim 2 further including a bolt locking means for axially retaining said bolt means engaged within all of said locking apertures.

4. A latch assembly as set forth in claim 3 wherein said bolt locking means comprises a detent means extending radially outward from the circumferential surface of said bolt means and a cut-out portion on said groove whereby said detent means is rotatable into engagement with said cut-out portion to axially retain said bolt means in a fixed position.

5. A latch assembly as set forth in claim 4 wherein said cut-out portion extends through said groove so that said detent means is rotatable through a range of substantially 180° to axially lock and unlock said bolt means when said detent means is longitudinally aligned with said cut-out portion.

6. A latch assembly as set forth in claim 5 further including a safety shoulder, said safety shoulder being disposed on top of said bolt mounting channel adjacent to said cut-out portion so that when said bolt means is received within said locking apertures and said detent means is in an unlocked disposition, said detent means and said bolt means will be shielded against accidental axial movement and corresponding unlocking of said cover portion.

7. A latch assembly for an article wherein the article includes a base portion and cover hingedly connected to one another for movement between open and closed positions relative thereto, said latch assembly comprising: at least one locking aperture disposed in each of said base and cover portions, said locking apertures being aligned with one another in the closed position of said cover portion;

a bolt means being mounted on said article and axially slidable in said locking apertures when said cover portion is in its closed position so that said base and cover portions may be selectively locked together, wherein said bolt means is axially slidable and rotatably mounted within a trough-shaped groove on said article, said trough-shaped groove including resilient sidewall portions for retaining said bolt means in sliding engagement with the bottom of said trough-shaped groove.

8. A latch assembly as set forth in claim 7 further including a bolt locking means for axially retaining said bolt means engaged within said locking apertures, said bolt locking means comprising a detent means extending radially outward from the circumferential surface of said bolt means and a cutout portion on said trough-shaped groove whereby said detent means is rotatable into engagement with said cutout portion to axially retain said bolt means in a fixed position.

* * * * *